US011237500B2

(12) United States Patent
Oikawa et al.

(10) Patent No.: US 11,237,500 B2
(45) Date of Patent: Feb. 1, 2022

(54) DEVELOPING DEVICE WITH STRUCTURE TO PREVENT SCATTERING TONER USING MAGNETIC REPULSIVE FORCE

(71) Applicant: HEWLETT-PACKARD DEVELOPMENT COMPANY, L.P., Spring, TX (US)

(72) Inventors: Mitsuru Oikawa, Gyeonggi-do (KR); Jong-Hyun Park, Gyeonggi-do (KR); Hojin Jang, Gyeonggi-do (KR)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 17/258,927

(22) PCT Filed: May 24, 2019

(86) PCT No.: PCT/US2019/033951
§ 371 (c)(1),
(2) Date: Jan. 8, 2021

(87) PCT Pub. No.: WO2020/091844
PCT Pub. Date: May 7, 2020

(65) Prior Publication Data

US 2021/0294244 A1 Sep. 23, 2021

(30) Foreign Application Priority Data

Nov. 1, 2018 (KR) ..... 10-2018-0133019

(51) Int. Cl.
*G03G 15/09* (2006.01)
*G03G 15/08* (2006.01)

(52) U.S. Cl.
CPC ..... *G03G 15/0942* (2013.01); *G03G 15/0921* (2013.01); *G03G 15/0812* (2013.01)

(58) Field of Classification Search
CPC ..... G03G 15/0942; G03G 15/0921; G03G 15/0812
See application file for complete search history.

(56) References Cited

U.S. PATENT DOCUMENTS 4,583,112 A 4/1986 Morano et al.
7,561,838 B2 * 7/2009 Sakamaki ..... G03G 15/0921 399/269

(Continued)

FOREIGN PATENT DOCUMENTS

JP H08137275 A 5/1996
JP 20050084557 3/2005

(Continued)

*Primary Examiner* — Susan S Lee
(74) *Attorney, Agent, or Firm* — Trop Pruner & Hu, P.C.

(57) ABSTRACT

A developing device including a developing sleeve installed in a developing chamber and partially exposed to an outside of the developing chamber through an opening portion, a magnetic member located inside a developing sleeve and including a separating pole and a receiving pole, the separating pole being located on a downstream side of the opening portion based on a rotating direction of the developing sleeve to separate a developing agent from the developing sleeve, and the receiving pole being located on a downstream side of the separating pole to attach the developing agent to the developing sleeve, and a magnet located between an inner wall of the developing chamber and the magnetic member to face a region between the separating pole and the receiving pole and having same magnetic polarity same as the separating pole and the receiving pole.

18 Claims, 9 Drawing Sheets

(56) References Cited

U.S. PATENT DOCUMENTS

| | | | | |
|---|---|---|---|---|
| 8,811,854 | B2 * | 8/2014 | Nose | G03G 15/0942 399/104 |
| 9,128,418 | B2 | 9/2015 | Okuma et al. | |
| 2007/0140729 | A1 | 6/2007 | Carter, II | |
| 2009/0232543 | A1 | 9/2009 | Urasawa et al. | |
| 2013/0287431 | A1 | 10/2013 | Fukamachi | |
| 2015/0050040 | A1 | 2/2015 | Yamazaki | |
| 2015/0093139 | A1 | 4/2015 | Kuramoto et al. | |
| 2016/0091830 | A1 * | 3/2016 | Furukawa | G03G 15/0921 399/104 |

FOREIGN PATENT DOCUMENTS

| | | |
|---|---|---|
| JP | 20050346035 | 12/2005 |
| JP | 2006039017 | 2/2006 |
| JP | 20060317666 | 11/2006 |
| JP | 20090115970 | 5/2009 |
| JP | 2009251036 | 10/2009 |

* cited by examiner

DEVELOPING DEVICE WITH STRUCTURE TO PREVENT SCATTERING TONER USING MAGNETIC REPULSIVE FORCE

BACKGROUND

An image forming apparatus using an electrophotographic method supplies a toner to an electrostatic latent image formed on a photoconductor to form a visible toner image on the photoconductor and transfers the toner image to a print medium and then fix the transferred toner image on the print medium to print an image on a recording medium. A developing device accommodates a toner and supplies the toner to an electrostatic latent image formed on a photoconductor to form a visible toner image on the photoconductor.

As a printing speed of the image forming apparatus is increased, a developing roller is rotated at a high speed. Air is introduced into the developing device by the high-speed rotation of the developing roller and an internal pressure of the developing device is increased, and thus toner scattering due to leakage of the toner from the developing roller may occur.

DETAILED DESCRIPTION

Figure 1:
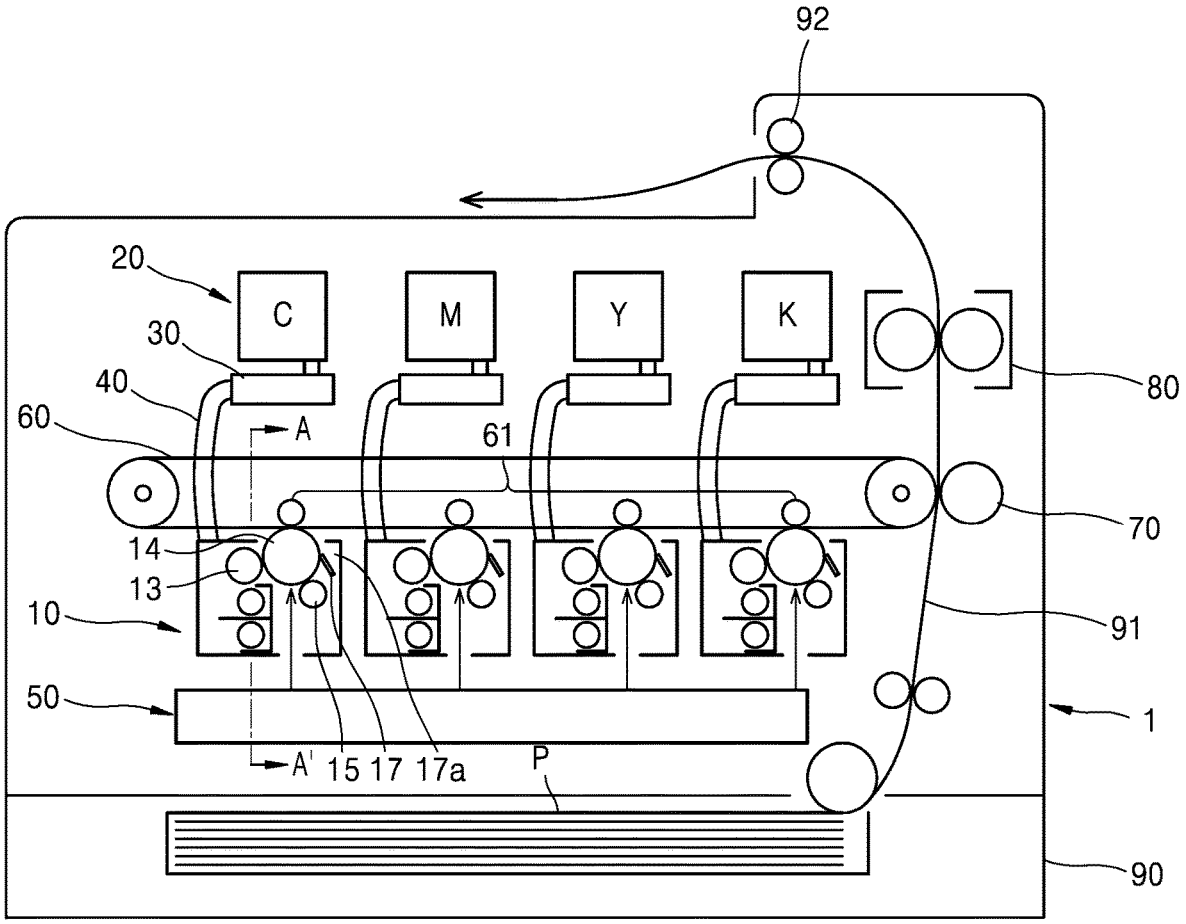
FIG. 1 is a schematic configuration diagram of an example of an electrophotographic image forming apparatus.

Hereinafter, examples of a developing device and examples of an electrophotographic image forming apparatus using the developing device will now be described in detail with reference to the accompanying drawings. In the following description and drawings, elements having substantially the same function and configuration are denoted by the same reference numerals, and redundant description will be omitted.

FIG. 1 is a schematic configuration diagram of an example of an electrophotographic image forming apparatus. The image forming apparatus of the present example prints a color image by an electrophotographic method. Referring to FIG. 1, the image forming apparatus may include a developing device 10, an exposure device 50, a transfer unit, and a fuser 80.

The image forming apparatus may further include a plurality of development cartridges 20 accommodating a developing agent. The plurality of development cartridges 20 may be respectively connected to a plurality of developing devices 10, and the developing agent accommodated in the plurality of development cartridges 20 is supplied to each of the plurality of developing devices 10. The plurality of development cartridges 20 and the plurality of developing devices 10 may be mountable/demountable in/from a main body 1 and may be individually replaced.

In an example, the plurality of developing devices 10 may include a plurality of developing devices 10C, 10M, 10Y, and 10K forming toner images of colors of cyan C, magenta M, yellow Y, and black K. The plurality of development cartridges 20 may include a plurality of development cartridges 20C, 20M, 20Y, and 20K each accommodating a developing agent supplying colors of cyan C, magenta M, yellow Y, and black K to be supplied to the plurality of developing devices 10C, 10M, 10Y, and 10K. Unless otherwise specified, reference symbols C, M, Y, and K refer to a configuration component for developing the developing agent of colors of cyan C, magenta M, yellow Y, and black K.

Figure 2:
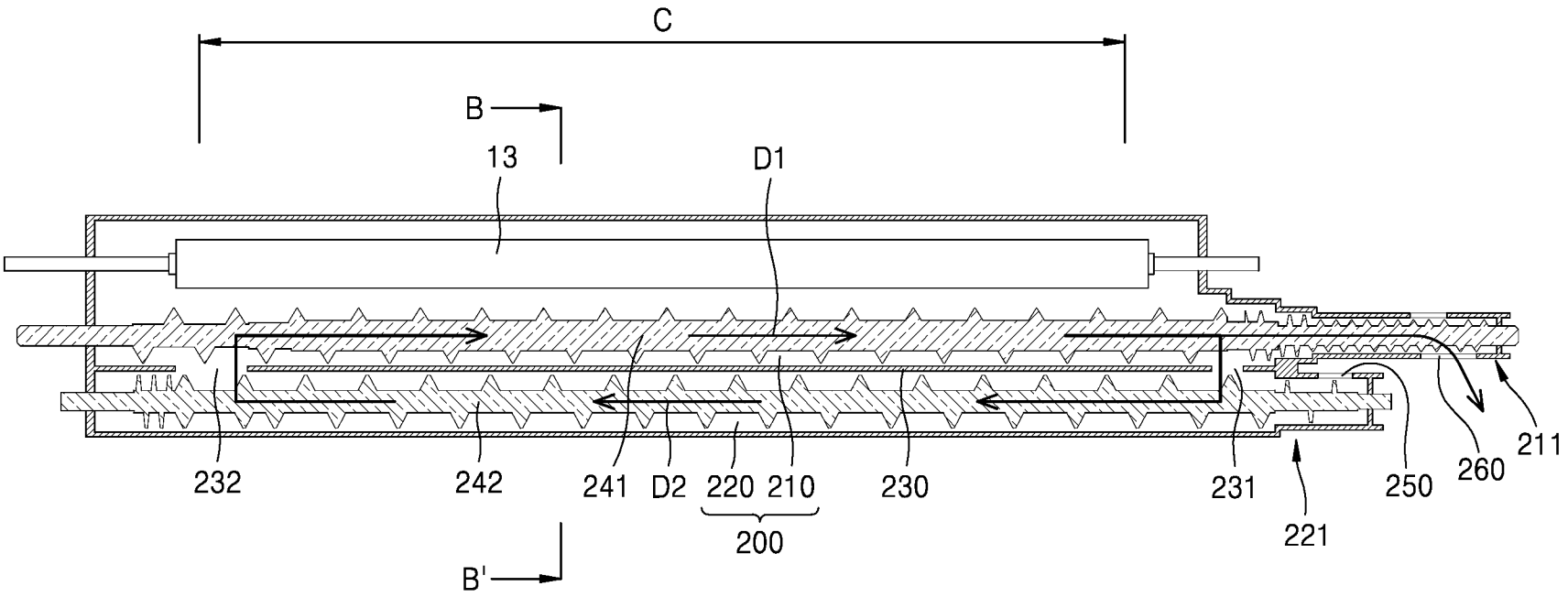
FIG. 2 is a cross-sectional view taken along a line A-A' of an example of the developing device shown in FIG. 1.
Figure 3:
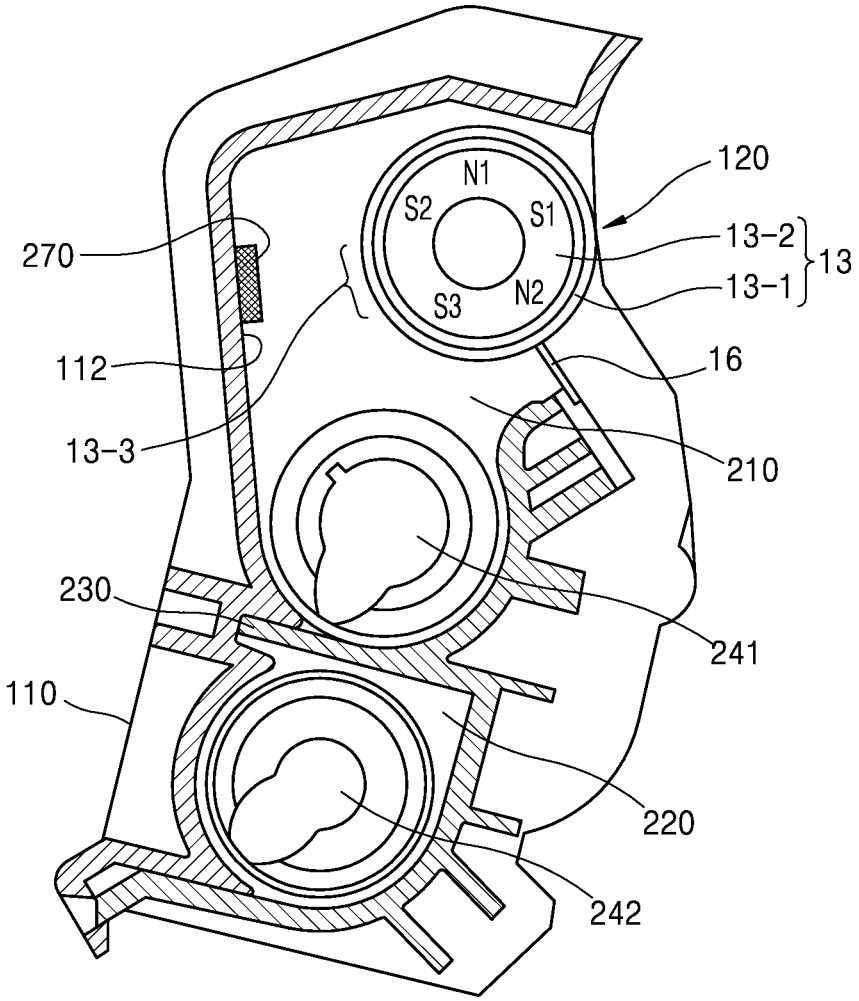
FIG. 3 is a cross-sectional view taken along a line B-B' in FIG. 2.

FIG. 2 is a cross-sectional view taken along a line A-A' of an example of the developing device 10 shown in FIG. 1. FIG. 3 is a cross-sectional view taken along a line B-B' in FIG. 2. Referring FIGS. 1 to 3, the developing device 10 may include a photoconductive drum 14 on which an electrostatic latent image is formed and a developing roller 13 supplying a developing agent to the electrostatic latent image to develop a visible toner image. The photoconductive drum 14 is an example of a photoconductor on which an electrostatic latent image is formed and may include a conductive metal pipe and a photoconductive layer formed on a periphery of the conductive metal pipe. A charging roller 15 is an example of a charger which charges the photoconductive drum 14 to have a uniform surface electric potential. Instead of the charging roller 15, a charging brush, a corona charger, or the like may be used.

Although not illustrated in drawings, the developing device 10 may further include a charging roller cleaner removing foreign matters such as a developing agent or dust attached to the charging roller 15, a cleaning member 17 removing a developing agent remaining on a surface of the photoconductive drum 14 after executing an intermediate transfer operation described later, and a regulating member 16 regulating an amount of developing agent supplied to an area where the photoconductive drum 14 and the developing roller 13 face each other. A waste developing agent may be accommodated in a waste developing agent container 17*a*. The cleaning member 17 may be, for example, a cleaning blade being brought into contact with a surface of the photoconductive drum 14 to scrape the developing agent. Although not illustrated in drawings, the cleaning member 17 may be a cleaning brush being brought into contact with the surface of the photoconductive drum 14 to scrape the developing agent while being rotated.

The developing agent accommodated in the development cartridge 20, that is, a toner and a carrier are supplied to the developing device 10. The developing roller 13 is positioned apart from the photoconductive drum 14. A distance between a periphery surface of the developing roller 13 and a periphery surface of the photoconductive drum 14 may be, for example, several tens of microns to several hundreds of microns. The developing roller 13 may include a developing sleeve 13-1 in FIG. 3 which is rotatable and a magnetic member 13-2 in FIG. 3 arranged inside the developing sleeve 13-1. The magnetic member 13-2 is not rotatable. In the developing device 10, the toner is mixed with the carrier, and the toner is attached to a surface of a magnetic carrier.

The magnetic carrier is attached on a surface of the developing roller 13 to be conveyed to a developing region where the photoconductive drum 14 and the developing roller 13 face each other. The regulating member 16 regulates an amount of developing agent conveyed to the developing region. The toner is supplied to the photoconductive drum 14 by a developing bias voltage applied between the developing roller 13 and the photoconductive drum 14 to develop an electrostatic latent image formed on a surface of the photoconductive drum 14 into a visible toner image.

An exposure device 50 forms an electrostatic latent image on the photoconductive drum 14 by irradiating the photoconductive drum 14 with modulated light corresponding to image information. A representative example of the exposure device 50 may include a laser scanning unit (LSU) using a laser diode as a light source or a LED exposure unit using a light emitting diode (LED) as a light source.

The transfer unit transfers a toner image formed on the photoconductive drum 14 to a print medium P. In the present example, an intermediate transfer unit is used. In an example, the transfer unit may include an intermediate transfer belt 60, an intermediate transfer roller 61, and a transfer roller 70.

The intermediate transfer belt 60 temporarily accommodates a toner image developed on the photoconductive drum 14 of a plurality of developing devices 100, 10M, 10Y, and 10K. A plurality of intermediate transfer rollers 61 are arranged at positions facing the photoconductive drums 14 of the plurality of developing devices 10C, 10M, 10Y, 10K with the intermediate transfer belt 60 interposed therebetween. An intermediate transfer bias voltage is applied to the plurality of intermediate transfer rollers 61 to intermediately transfer a toner image developed on the photoconductive drum 14 to the intermediate transfer belt 60. Instead of the intermediate transfer roller 61, a corona transfer unit or a pin scorotron method of transfer unit may be used.

The transfer roller 70 is positioned facing the intermediate transfer belt 60. A transfer bias voltage is applied to the transfer roller 70 to transfer the toner image transferred from the intermediate transfer belt 60 to a print medium P.

The fuser 80 applies heat and/or pressure to the toner image transferred to the print medium P, thereby the toner image being fixed on the print medium P. A shape of the fuser 80 is not limited to the example shown in FIG. 1.

With the above configurations, the exposure device 50 irradiates lights modulated according to image informations of each color to the photoconductive drums 14 of the plurality of developing devices 100, 10M, 10Y, and 10K to form electrostatic latent images on the photoconductive drum 14. The electrostatic latent images of the photoconductive drums 14 of the plurality of developing devices 100, 10M, 10Y, and 10K are developed into visible toner images by the developing agents C, M, Y, and K supplied to the plurality of developing devices 10C, 10M, 10Y, and 10K from the plurality of development cartridges 20C, 20M, 20Y, and 20K. Developed toner images are intermediately transferred to the intermediate transfer belt 60. The print medium P loaded on a paper feeding unit 90 is transported along a paper feeding path 91 and transported between the transfer roller 70 and the intermediate transfer belt 60. The toner images intermediately transferred onto the intermediate transfer belt 60 are transferred to the print medium P by the transfer bias voltage applied to the transfer roller 70. When the print medium P passes through the fuser 80, the toner images are fixed on the print medium P by heat and pressure. The print medium P on which the fixing has been completed is discharged by a discharge roller 92.

The developing agent accommodated in the development cartridge 20 is supplied to the developing device 10. When all developing agent accommodated in the development cartridge 20 is consumed, the development cartridge 20 may be replaced with a new development cartridge 20, and a new developing agent may be refilled into the development cartridge 20.

The image forming apparatus may further include a developing agent supply unit 30. The developing agent supply unit 30 receives the developing agent from the development cartridge 20 and supplies the developing agent to the developing device 10. The developing agent supply unit 30 is connected to the developing device 10 by a supply duct 40. Although not illustrated in drawings, the developing agent supply unit 30 may be omitted and the supply duct 40 may directly connect the development cartridge 20 and the developing device 10.

Referring to FIGS. 2 and 3, the developing device 10 may include a developing casing 110 and the developing roller 13 rotatably supported on the developing casing 110. A developing agent is accommodated in the developing casing 110. As described above, the developing agent may be supplied form the development cartridge 20. A developing agent transporting path 200 is provided inside the developing casing 110. The developing agent is conveyed along the developing agent transporting path 200 and stirred. The developing roller 13 is installed in the developing agent transporting path 200. The developing agent transporting path 200 may include a developing chamber 210 and a stirring chamber 220.

The developing chamber 210 is provided with an opening portion 120 opened toward the photoconductive drum 14. The developing roller 13 is installed in the developing chamber 210. The developing roller 13 is partly exposed to the outside of the developing chamber 210 through the opening portion 120 and the exposed portion of the developing roller 13 faces the photoconductive drum 14. The developing roller 13 supplies a toner accommodated in the developing chamber 210 to the electrostatic latent image formed on the photoconductive drum 14 through the opening portion 120 to develop the electrostatic latent image into a toner image. The stirring chamber 220 is separated from the developing chamber 210 by a partition 230.

A first conveying member 241 may be provided in the developing chamber 210 and a second conveying member 242 may be provided in the stirring chamber 220. The first conveying member 241 and the second conveying member 242 stir the toner and the carrier while respectively conveying the developing agent inside the developing chamber 210 and the stirring chamber 220 in a longitudinal direction of the developing roller 13. The first conveying member 241 and the second conveying member 242 may be, for example, an auger having a helical wing. The first conveying member 241 and the second conveying member 242 convey the developing agent in opposite directions to each other. For example, the first conveying member 241 and the second conveying member 242 conveys the developing agent respectively in a first direction D1 and a second direction D2. A first communicating hole 231 and a second communicating hole 232 are provided at both ends of the partition 230 in the longitudinal direction to communicate the developing chamber 210 and the stirring chamber 220. The developing agent in the developing chamber 210 is conveyed from the second communicating hole 232 to the first direction D1 by the first conveying member 241 The developing agent is conveyed to the stirring chamber 220 through the first communicating hole 231 provided at an end of the partition 230 in the first direction D1. The developing agent in the stirring chamber 220 is conveyed from the first communicating hole 231 to the second direction D2 by the second conveying member 242. The developing agent is conveyed to the developing chamber 210 through the second communicating hole 232 provided at an end of the partition 230 in the second direction D2. With the above-mentioned configuration, the developing agent is circulated along a circulation path formed by the developing chamber 210-the first communicating hole 231-the stirring chamber 220-the second communicating hole 232-the developing chamber 210. A portion of the developing agent conveyed in the developing chamber 210 in the first direction D1 is attached to the developing roller 13 and the toner of the developing agent is supplied to the photoconductive drum 14.

The developing device 10 of the present example uses an auto developer refill (ADR) method. An excess developing agent is discharged to the outside of the developing device 10 to maintain an amount of the developing agent in the developing device 10 constant.

The developing agent from the development cartridge 20 is supplied to the inside of the developing device 10, that is, the developing agent transporting path 200, via a developing agent supply hole 250. The developing agent supply hole 250 is located outside an effective image region C of the developing roller 13. The effective image region C refers to a region used for effective image formation within a length of the developing roller 13. A length of the effective image region C may be slightly greater than a width of the print medium P of a maximum size used in the image forming apparatus. The effective image region C may be an inside of the first communicating hole 231 and the second communicating hole 232. The developing agent supply hole 250 may be located outside the first communicating hole 231 and the second communicating hole 232.

In an example, the developing device 10 may include a developing agent supply portion 221 extending from the developing agent transporting path 200 in the longitudinal direction of the developing roller 13. The developing agent supply hole 250 may be provided in the developing agent supply portion 221. For example, the developing agent supply portion 221 may extend in the first direction D1 from an upstream side of the stirring chamber 220 based on a flow direction of the developing agent inside the stirring chamber 220, that is, the second direction D2. The second conveying member 242 extends inside the developing agent supply portion 221. The developing agent supplied to the stirring chamber 220 through the developing agent supply hole 250 is conveyed by the second conveying member 242 in the second direction D2.

Excess developing agent is discharged to the outside of the developing device 10 through a developing agent discharge hole 260. The discharged excess developing agent may be accommodated in a waste developing agent container (not shown). The developing agent discharge hole 260 is located outside the effective image region C of the developing roller 13. The developing agent discharge hole 260 may be located outside the first communicating hole 231 and the second communicating hole 232. In an example, the developing device 10 may include a developing agent discharge portion 211 extending from the developing agent transporting path 200 in the longitudinal direction of the developing roller 13. The developing agent discharge hole 260 may be provided in the developing agent discharge portion 211. For example, the developing agent discharge portion 211 may be extended, in the first direction D1, from a downstream side of the developing chamber 210 based on a flow direction of the developing agent inside the developing chamber 210, that is, the first direction D1. The first conveying member 241 extends inside the developing agent discharge portion 211. Excess developing agent is conveyed by the first conveying member 241 and is discharged to the outside of the developing device 10 through the developing agent discharge hole 260.

As described above, the developing roller 13 includes the developing sleeve 13-1 and the magnetic member 13-2. The developing sleeve 13-1 is installed in the developing chamber 210 and partially exposed to the outside of the developing chamber 210 through the opening portion 120 to face the photoconductive drum 14.

The magnetic member 13-2 may include a plurality of magnetic poles. The plurality of magnetic poles include a first magnetic pole and a second magnetic pole sequentially located on a downstream side of the opening portion 120 of the developing chamber 210 based on a rotating direction of the developing sleeve 13-1 The first magnetic pole and the second magnetic pole have a same magnetic polarity. The first magnetic pole may be a separating pole S2 located on the downstream side of the opening portion 120 based on the rotating direction of the developing sleeve 13-1 to separate the developing agent from the developing sleeve 13-1. The second magnetic pole may be a receiving pole S3 located on a downstream side of the first magnetic pole, that is, the separating pole S2 to attach the developing agent to the developing sleeve 13-1. The plurality of magnetic poles may further include a main pole S1 located in the opening portion 120 of the developing chamber 210 to face the photoconductive drum 14, a transporting pole N1 located on a downstream side of the main pole S1, and a regulating pole N2 located between the receiving pole S3 and the main pole S1. With the above-mentioned configurations, the transporting pole N1, the separating pole S2, the receiving pole S3, and the regulating pole N2 may be sequentially arranged from the main pole S1 in the rotating direction of the developing sleeve 13-1. The separating pole S2 and the receiving pole S3 may have a same magnetic polarity. In the present example, magnetic polarities of the separating pole S2, receiving pole S3, and the main pole S1 are S poles, magnetic polarities of the transporting pole N1 and the regulating pole N2 are N poles.

A developing agent layer formed on a periphery of the developing sleeve 13-1 by a magnetic force of the receiving pole S3 is transported to the regulating pole N2 as the developing sleeve 13-1 is rotated. The developing agent layer is regulated to have a constant thickness while the developing agent layer passes through between the developing sleeve 13-1 and the regulating member 16. The developing agent layer regulated to have the constant thickness is conveyed to the main pole S1 as the developing sleeve 13-1 is rotated. A toner from the developing agent layer formed on a surface of the developing sleeve 13-1 is attached to an electrostatic latent image formed on a surface of the photoconductive drum 14 by the developing bias voltage applied to the developing sleeve 13-1. The developing agent remaining on the periphery of the developing sleeve 13-1 after passing through the main pole S1 is conveyed to the separating pole S2 through the transporting pole N1. The developing agent in the separating pole S2 is separated from the periphery of the developing sleeve 13-1 by a repulsive magnetic field formed by the separating pole S2 and the receiving pole S3 and falls into the developing chamber 210. With such circulating configuration mentioned above, a developing agent in which a new toner is attached is supplied to the developing roller 13.

When the developing agent is separated from the developing sleeve 13-1 in a region facing the separating pole S2, the developing agent is separated in a tangential direction of the developing sleeve 13-1. The separated developing agent flies towards an inner wall 112 of the developing chamber 210 and collides with the inner wall 112. Due to the collision of the separated developing agent and the inner wall 210, toner scattering occurs in the developing chamber 210 and the toner may leak to the outside of the developing device 10. When the developing agent repeatedly collides with the inner wall 112 of the developing chamber 210, a performance of the developing agent may deteriorate. A portion of the developing agent collided with the inner wall 112 may be instantly attached to the receiving pole S3 without falling into the developing chamber 210. Since the developing agent instantly attached to the receiving pole S3 without passing through the developing chamber 210 is in a state in which the toner and the carrier are not sufficiently stirred, a toner concentration of the developing agent is low and may cause a decrease in a density of a printed image. A speed of the developing agent when being separated from the developing sleeve 13-1 increases as a rotation linear velocity of the developing sleeve 13-1 increases. Therefore, a collision of the developing agent with the inner wall 112 of the developing chamber 210 and the toner scattering, the deterioration of the performance of the developing agent, and the decrease in an image density due to the collision may become worse as a printing speed is increased.

Referring to FIG. 3, the developing device 10 of the present example includes a magnet 270 having a same magnetic polarity with the separating pole S2 and the receiving pole S3, the magnet being located between the inner wall 112 of the developing chamber 210 and the magnetic member 13-2 to face a region between the separating pole S2 and the receiving pole S3. A magnetic polarity of a surface of the magnet 270 facing the separating pole S2 and the receiving pole S3 is the same as the magnetic polarities of the separating pole S2 and the receiving pole S3. For example, the magnetic polarity of the separating pole S2, the receiving pole S3, and the magnet may be a S pole. A length of the magnet 270 may be approximately equal to a length of magnetic poles of the magnetic member 13-2. For example, the magnet 270 may be a rubber magnet having a length of 300 mm, a width of 3 mm, and a thickness of 0.4 mm. A surface magnetic flux density of the magnet 270 may be, for example, about 5 mT to 15 mT.

Figure 4:
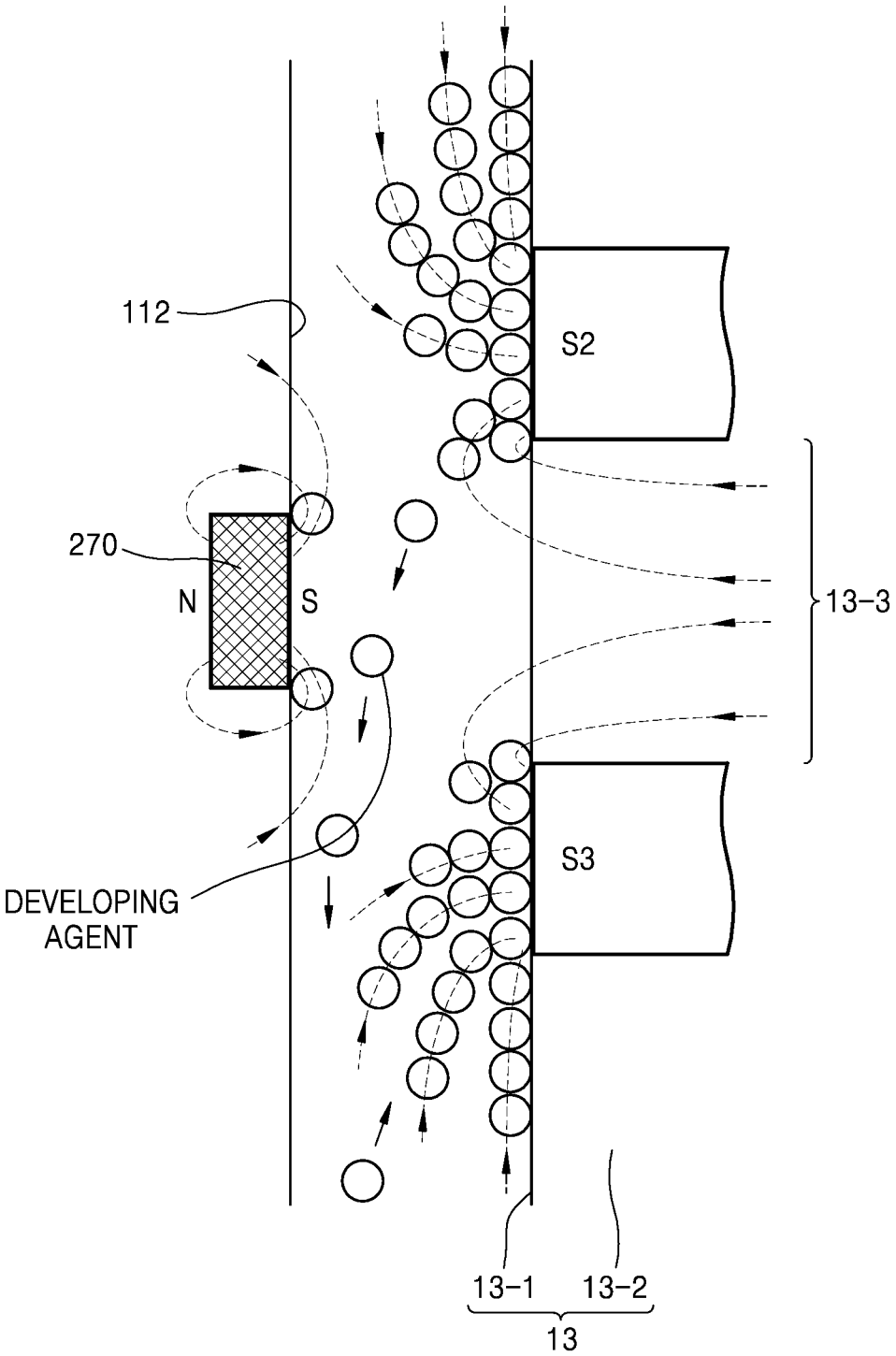
FIG. 4 is a view illustrating an application of a magnet in an example of the developing device shown in FIG. 3.

FIG. 4 is a view illustrating an application of the magnet 270 in an example of the developing device 10 shown in FIG. 3. The developing sleeve 13-1 in FIG. 4 is shown in a linear form. Although the developing agent is in a state in which a toner is electrically attached to a surface of a carrier, the developing agent is shown as a circle in FIG. 4. Referring to FIG. 4, the magnet 270 has same magnetic polarity as the separating pole S2 and the receiving pole S3 and is located on the inner wall 112 to face the separating pole S2 and the receiving pole S3. The developing agent separated from the developing sleeve 13-1 moves along lines of magnetic force. However, a moving trajectory of the developing agent is changed and the developing agent may fall into the developing chamber 210 without colliding with the inner wall 112 on which the magnet 270 is installed due to a repulsive magnetic field between the separating pole S2 and the magnet 270, and a repulsive magnetic field between the magnet 270 and the receiving pole S3. In addition, since a speed of the developing agent may be lowered by the repulsive magnetic field, even when a portion of the developing agent collides with the inner wall 112, a possibility of occurring toner scattering may be reduced since the collision speed is low.

The magnet 270 may face a region 13-3 between a position where a magnetic flux density of the separating pole S2 in a normal direction is a maximum and a position where a magnetic flux density of the receiving pole S3 in the normal direction is a maximum. According to the above-mentioned configuration, the repulsive magnetic field generated by the magnet 270 may effectively change the trajectory of the developing agent so that the developing agent may not hit the inner wall 112.

As described above, the developing agent does not collide with the inner wall 112 or even when the developing agent collides with the inner wall 112, the toner scattering and the deterioration of the performance of the developing agent may be reduced or prevented since the collision speed is low. In addition, since a possibility that the developing agent separated from the separating pole S2 instantly attaches to the receiving pole S3 may be reduced, a decrease in an image density may be reduce or prevented.

The magnet 270 may be arranged to protrude from the inner wall 112 as shown in FIG. 3, and may be partially or wholly immersed in the inner wall 112 as shown in FIG. 4.

When the developing sleeve 13-1 is rotated, air flows from the outside of the developing chamber 210 into the inside of the developing chamber 210, and thus an air pressure inside the developing chamber 210 may be increased. As a printing speed of the image forming apparatus increases, a rotating speed of the developing sleeve 13-1 may increase, and an inflow speed and an amount of the air introduced into the developing chamber 210 from the outside of the developing device 10 may be increased. When the air pressure inside the developing chamber 210 increases, a possibility of occurring the toner scattering in which the toner leaks to the outside of the developing chamber 210 may be increased. In a case of the ADR method, when excess developing agent is discharged through the developing agent discharge hole 260, the air inside the developing chamber 210 is also discharged together. When the air pressure inside the developing chamber 210 is increased, discharge pressure of the air through the developing agent discharge hole 260 is increased. The discharge pressure of the air may increase a discharge speed of the developing agent through the developing agent discharge hole 260, and thus the developing agent may be excessively discharged. The excessive discharge of the developing agent excessively reduces an amount of developing agent inside the developing chamber 210 and the amount of the developing agent inside the developing chamber 210 may become insufficient, thereby causing a decrease in the image density.

Figure 5:
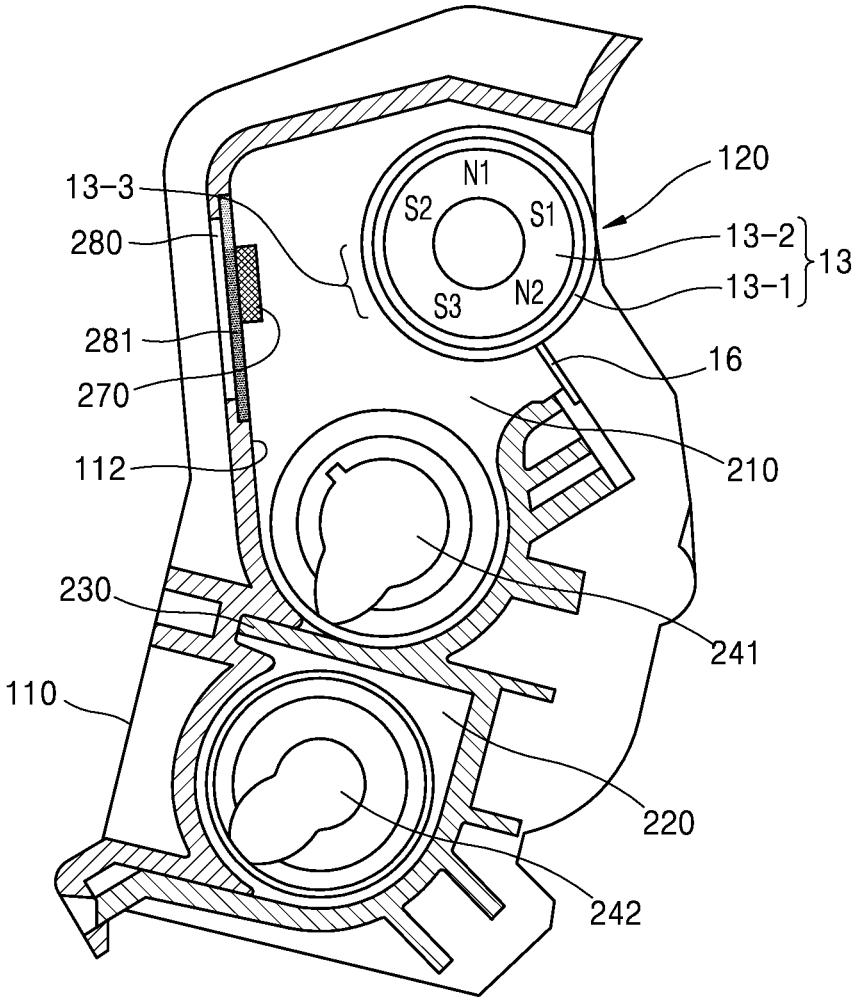
FIG. 5 is a schematic cross-sectional view of an example of a developing device.
Figure 6:
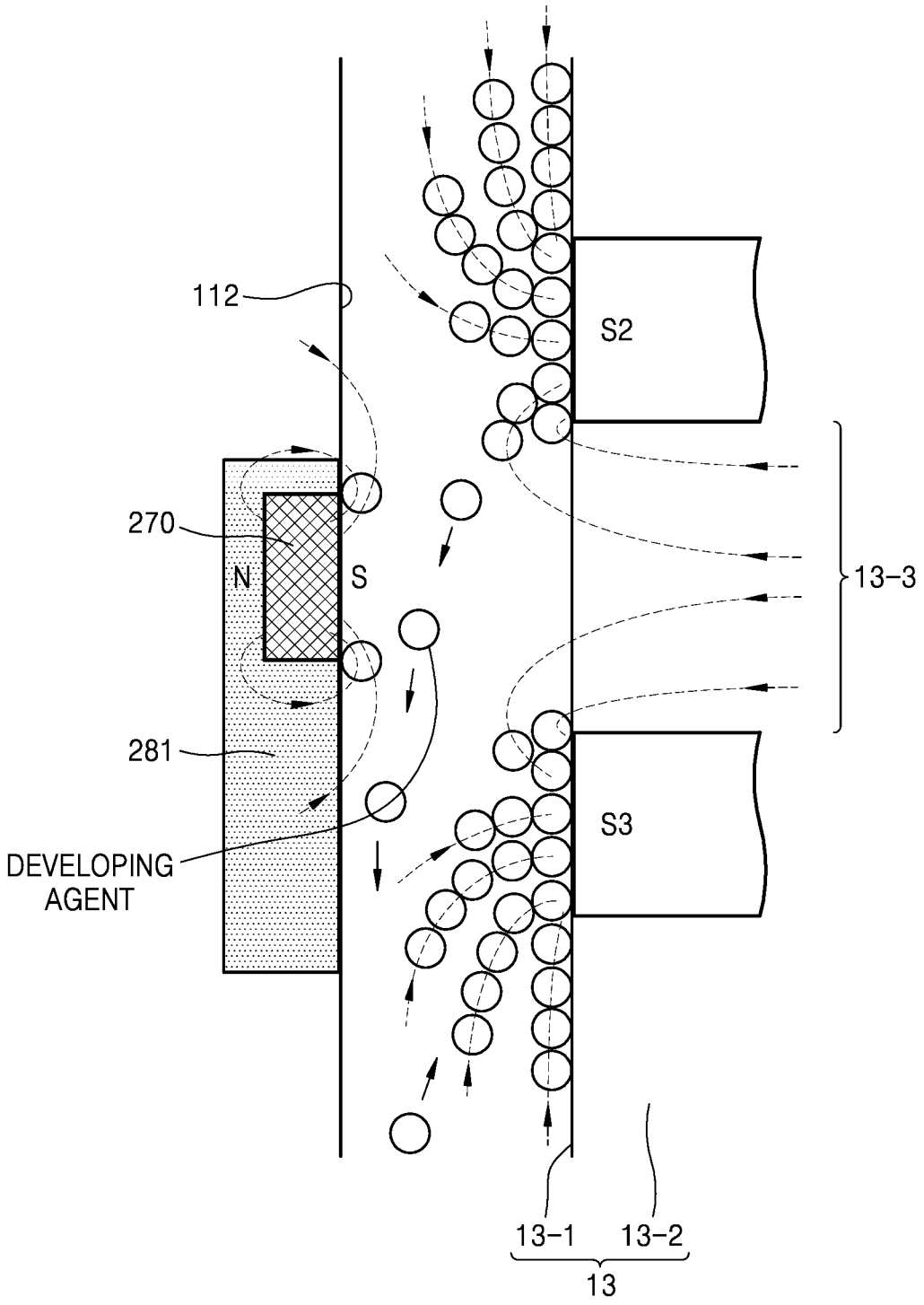
FIG. 6 is a view illustrating an application of a magnet in an example of the developing device shown in FIG. 5.

FIG. 5 is a schematic cross-sectional view of an example of the developing device 10. FIG. 6 is a view illustrating an application of the magnet 270 in an example of the developing device 10 shown in FIG. 5. The developing sleeve 13-1 in FIG. 6 is shown in a linear form. Although the developing agent is in a state in which a toner is electrically attached to a surface of a carrier, the developing agent is shown as a circle in FIG. 6. Referring to FIGS. 5 and 6, an air discharge hole 280 discharging air inside the developing chamber is provided in the inner wall 112. The air discharge hole 280 is provided with a filter 281 to filter the developing agent so that the developing agent does not leak out. The magnet 270 may be located between the filter 281 and the magnetic member 13-2. The magnet 270 may be installed on the filter 281. The magnet 270 is located to face a region between the separating pole S2 and the receiving pole S3 and has a magnetic polarity same as the magnetic polarities of the separating pole S2 and the receiving pole S3. A magnetic polarity of a surface of the magnet 270 facing the separating pole S2 and the receiving pole S3 is the same as the magnetic polarities of the separating pole S2 and the receiving pole S3. For example, the magnetic polarity of the separating pole S2, the receiving pole S3, and the magnet may be a S pole. A length of the magnet 270 may be approximately equal to a length of magnetic poles of the magnetic member 13-2. For example, the magnet 270 may be a rubber magnet having a length of 300 mm, a width of 3 mm, and a thickness of 0.4 mm. A surface magnetic flux density of the magnet 270 may be, for example, about 5 mT to 15 mT.

When the developing agent separated from the developing sleeve 13-1 flies toward the inner wall 112 and collides with the filter 281, the developing agent may be sandwiched between fibers on the filter 281, and thus a performance of the filter 281 may deteriorate. According to the present example, due to the repulsive magnetic field between the separating pole S2 and the magnet 270, and the repulsive magnetic field between the magnet 270 and the receiving pole S3, the trajectory of the developing agent is changed and the speed of the developing agent is lowered. Therefore the developing agent does not collide with the filter 281 or even when a portion of the developing agent collides with the filter 281, the developing agent is not attached to the fibers of the filter 281 since the collision speed is low. Therefore, toner scattering, deterioration of a performance of the developing agent, and a decrease in image density may be reduced or prevented, and deterioration of a performance of the filter 281 may be prevented. In addition, since the air inside the developing chamber 210 may be discharged to the outside of the developing device 10 by flowing through the air discharge hole 280 through the filter 281, excessive rise of the air pressure inside the developing chamber 210 and toner leakage due to the rise of air pressure and excessive discharge of the developing agent may be reduced or prevented.

The magnet 270 may be arranged to protrude from the filter 281 as shown in FIG. 5, and may be partially or wholly immersed in the filter 281 as shown in FIG. 6.

Figure 7:
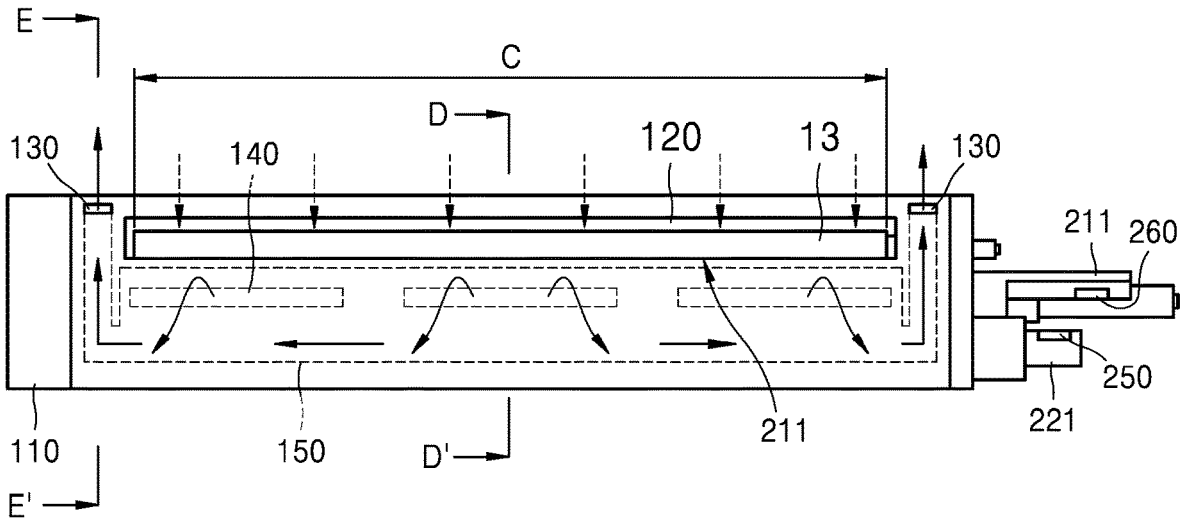
FIG. 7 is a side view of an example of a developing device.
Figure 8:
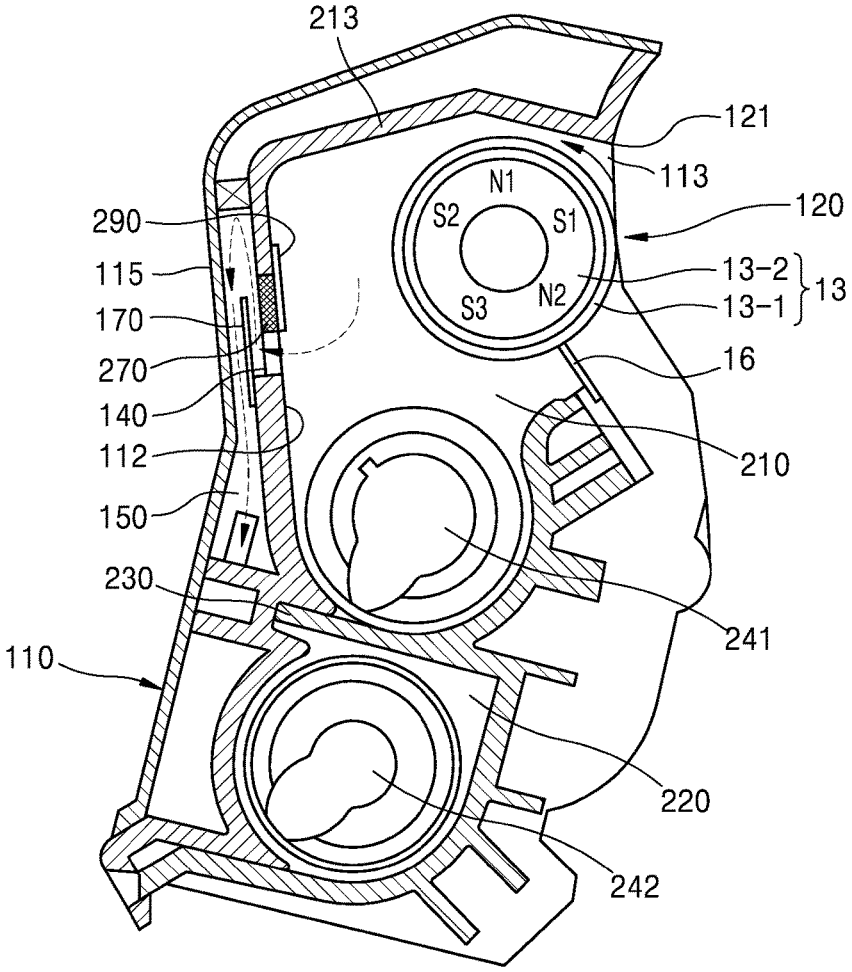
FIG. 8 is a sectional view taken along a line D-D' in FIG. 7.
Figure 9:
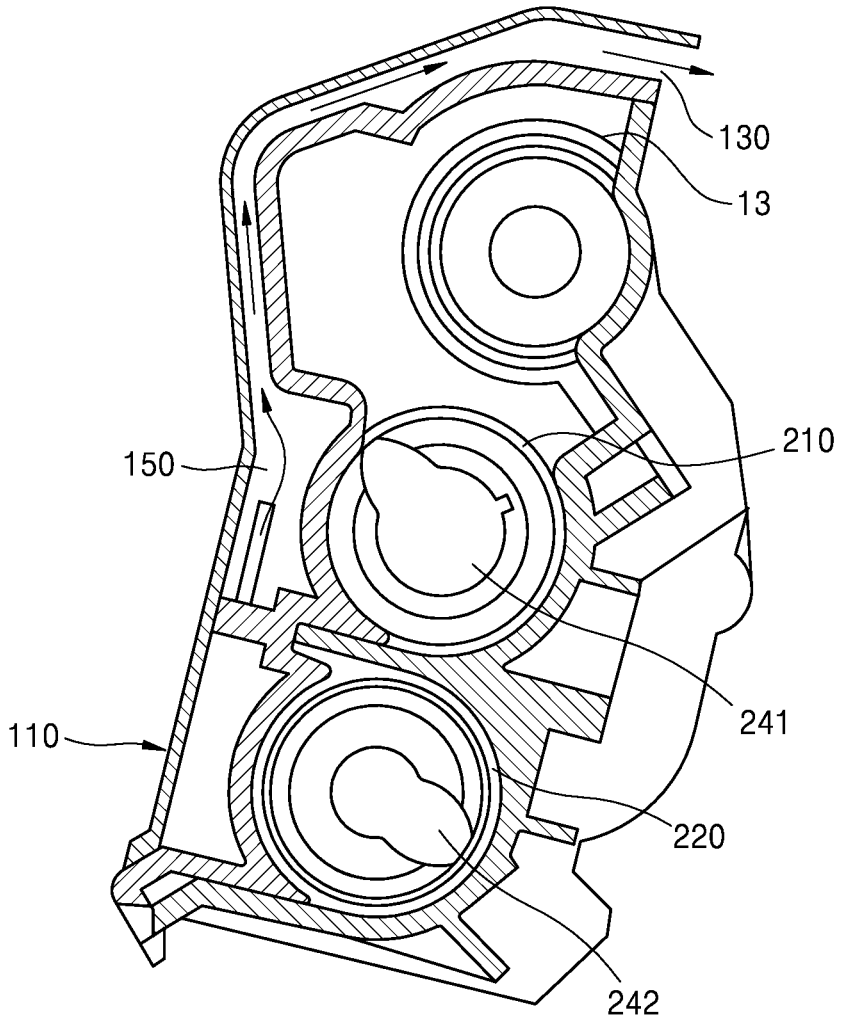
FIG. 9 is a sectional view taken along a line E-E' in FIG. 7.
Figure 10:
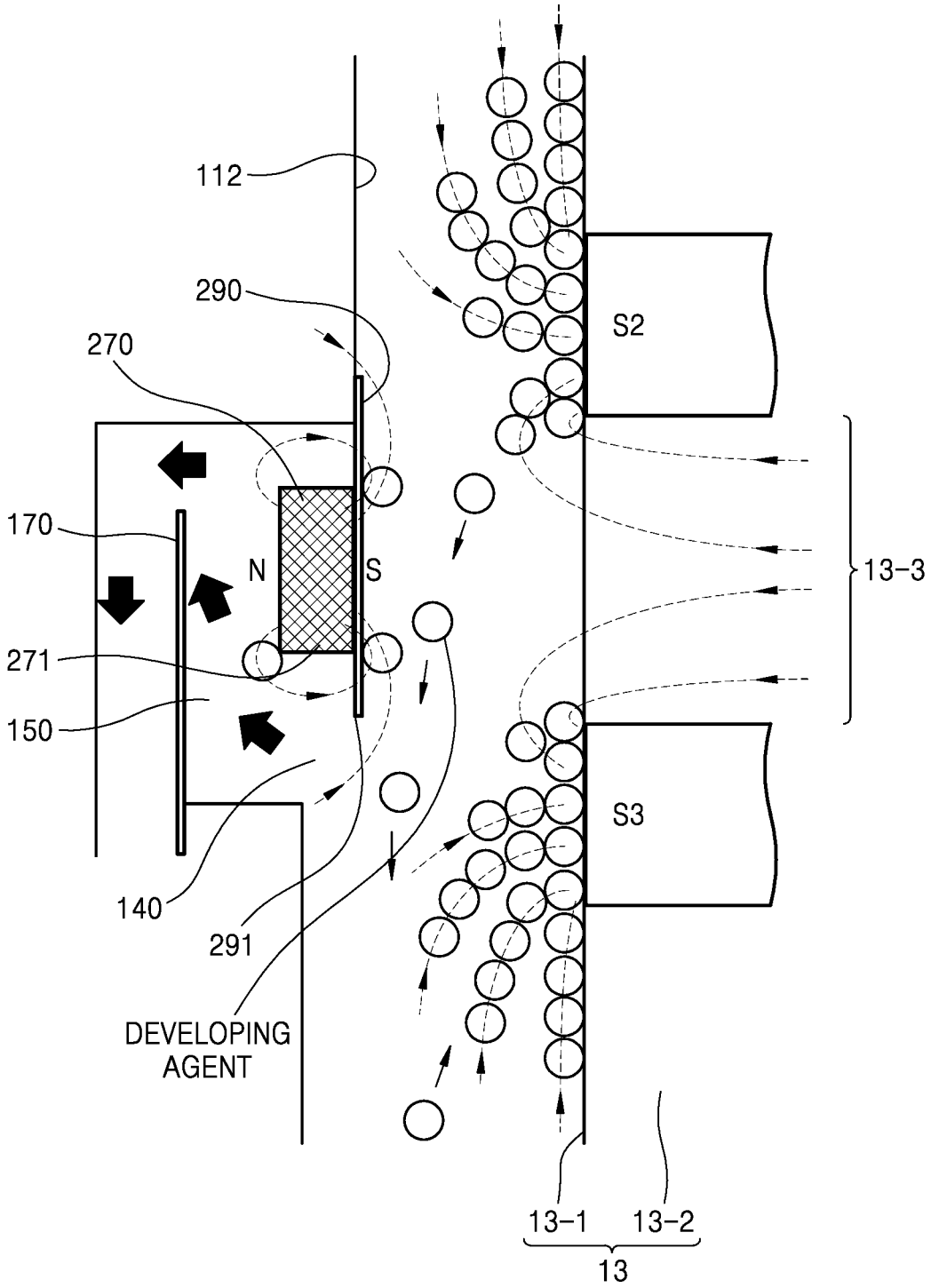
FIG. 10 is a view illustrating an application of a magnet in an example of the developing device in FIG. 8.

FIG. 7 is a side view of an example of the developing device 10. FIG. 8 is a sectional view taken along a line D-D' in FIG. 7; FIG. 9 is a sectional view taken along a line E-E' in FIG. 7; FIG. 10 is a view illustrating an application of the magnet 270 in an example of the developing device 10 in FIG. 8. The developing sleeve 13-1 in FIG. 10 is shown in a linear form. Although the developing agent is in a state in which a toner is electrically attached to a surface of a carrier, the developing agent is shown as a circle in FIG. 10. Referring to FIGS. 7 to 10, an air introducing hole 113 is formed between a downstream-side edge 121 of the opening portion 120 and a periphery of the developing sleeve 13-1 based on the rotating direction of the developing sleeve 13-1. Since the regulating member 16 is installed on an upstream-side edge of the opening portion 120 based on the rotating direction of the developing sleeve 13-1, the developing chamber 210 communicates with the outside through the air introducing hole 113. When the developing sleeve 13-1 is rotated, air from the outside of the developing device 10 is introduced into the developing chamber 210 through the air introducing hole 113.

As the printing speed of the image forming apparatus increases, the rotating speed of the developing sleeve 13-1 may increase, and an inflow speed and an amount of the air introduced into the developing chamber 210 from the outside of the developing device 10 may be increased. Therefore, the air pressure inside the developing chamber 210 may be increased. When the air pressure inside the developing chamber 210 becomes saturated, the air may be discharged to the outside of the developing device 10 through the air introducing hole 113. At this time, the developing agent may be discharged to the outside together with the air, and thereby contaminating the photoconductive drum 14 and the inside of the image forming apparatus.

The developing device 10 of the present example may include a first air discharge hole 140 provided in the inner wall 112 of the developing chamber 210 to discharge the air inside the developing chamber 210, so that the air pressure inside the developing chamber 210 may not excessively increase. A second air discharge hole 130 may be provided in the downstream-side edge 121 of the opening portion 120 based on the rotating direction of the developing sleeve 13-1 and outside the effective image region C in the longitudinal direction of the developing roller 13. The first air discharge hole 140 and the second air discharge hole 130 are connected to each other by an air discharge path 150.

The first air discharge hole 140 may be formed in the inner wall 112 of the developing chamber 210. A shape of the first air discharge hole 140 is not particularly limited. The first air discharge hole 140 may be in a form extending in the longitudinal direction of the developing roller 13. One first air discharge hole 140 or a plurality of first air discharge holes 140 may be formed in a central portion of the developing chamber 210. The first air discharge hole 140 may be formed in both-sides portion of the inner wall 112 of the developing chamber 210 in the longitudinal direction of the developing roller 13. The shape, number, and position of the first air discharge hole 140 may be appropriately determined so as to maintain the air pressure inside the developing chamber 210 at an appropriate level.

The second air discharge hole 130 may be formed near the downstream-side edge 121 of the opening portion 120. The second air discharge hole 130 may be located above the opening portion 120 based on a gravity direction. Since the air discharged from the second air discharge hole 130 may include the toner, the second air discharge hole 130 may be installed outside the effective image region C in the longitudinal direction of the developing roller 13. As a result, the printed image being contaminated by the toner contained in the discharged air may be prevented. The second air discharge hole 130 may be formed in one side of the effective image region C or in both sides of the effective image region C. Also, a plurality of second air discharge hole 130 may be formed in one side or both sides of the effective image region C. A number and an installation position of the second air discharge hole 130 may be appropriately determined so as to maintain the air pressure inside the developing chamber 210 at an appropriate level.

When the second air discharge hole 130 and the air introducing hole 113 are overlapped with each other in the longitudinal direction of the developing roller 13, the air discharged from the second air discharge hole 130 and the air towards the air introducing hole 113 may meet each other to generate an eddy. Then, the eddy may worsen the toner scattering. To consider this point, the second air discharge hole 130 may be arranged so as not to overlap with the air introducing hole 113 in the longitudinal direction of the developing roller 13.

The air discharge path 150 may have various forms of connecting the first air discharge hole 140 and the second air discharge hole 130. For example, the air discharge path 150 may be formed between the inner wall 112 of the developing chamber 210 and an outer wall 115 of the developing casing 110.

The magnet 270 may be arranged to reduce and prevent a discharge of the developing agent through the first air discharge hole 140. The magnet 270 may be located adjacent to the first air discharge hole 140. The magnet 270 may be located to face a region between the separating pole S2 and the receiving pole S3 and may have a magnetic polarity same as the magnetic polarities of the separating pole S2 and the receiving pole S3. A magnetic polarity of a surface of the magnet 270 facing the separating pole S2 and the receiving pole S3 is the same as the magnetic polarities of the separating pole S2 and the receiving pole S3. For example, the magnetic polarity of the separating pole S2, the receiving pole S3, and the magnet may be a S pole. A length of the magnet 270 may be approximately equal to a length of the magnetic poles of the magnetic member 13-2. For example, the magnet 270 may be a rubber magnet having a length of 300 mm, a width of 3 mm, and a thickness of 0.4 mm. A surface magnetic flux density of the magnet 270 may be, for example, about 5 mT to 15 mT.

According to the above configuration, the leakage of the developing agent through the first air discharge hole 140 may be effectively prevented. The magnet 270 may be located adjacent to an upstream-side end of the first air discharge hole 140 based on the rotating direction of the developing sleeve 13-1. Thus, the leakage of the developing agent through the first air discharge hole 140 may be effectively prevented.

A film 290 (a developing agent attachment preventing member) may be located between the magnet 270 and the magnetic member 13-2 to prevent the developing agent from attaching to the magnet 270. For example, the film 290 may be attached to the inner wall 112 of the developing chamber 210 to cover a surface of the magnet 270 facing the magnetic member 13-2. When the developing agent contacts the film 290, the developing agent slips due to a small surface roughness of the film 290 and falls into the developing chamber 210. Therefore, the developing agent attaching to the magnet 270 may be prevented and a repulsive magnetic field between the magnet 270, separating pole S2 and the receiving pole S3 may be effectively formed without being affected by the developing agent attached to the magnet 270. In addition, the developing agent attached to an edge of the magnet 270 being discharged with the air inside the developing chamber 210 through the first air discharge hole 140 may be prevented. A downstream side end 291 of the film 290 may extend over a downstream side end 271 of the magnet 270 based on the rotating direction of the developing sleeve 13-1. Thus, the leakage of the developing agent together with the air through the first air discharge hole 140 may be effectively prevented.

An air introducing member 170 introducing air introduced to the air discharge path 150 through the first air discharge hole 140 to an upward of the gravity direction may be provided between the magnet 270 and the outer wall 115 of the developing casing 110, that is, between the first air discharge hole 140 and the air discharge path 150. The air introducing member 170 may include, for example, a film attached to a surface of the inner wall 112 facing the air discharge path 150. With the above-mentioned configurations, since a travelling direction of the air introducing from the developing chamber 210 to the first air discharge hole 140 is changed to an upper side of the gravity direction, that is an opposite side of the gravity direction, the developing agent with heavy weight included in the air may not enter the air discharge path 150 and falls into the developing chamber 210, and thus air may be introduced to the air discharge path 150 without the developing agent with heavy weight.

Referring to FIG. 10, when the developing agent separated from the developing sleeve 13-1 flies towards the inner wall 112 of the developing chamber 210 and enters the first air discharge hole 140, the developing agent scatters to the outside of the developing device 10. According to the present example, due to the repulsive magnetic field between the separating pole S2 and the magnet 270, and the repulsive magnetic field between the magnet 270 and the receiving pole S3, the trajectory of the developing agent is changed and the speed of the developing agent is lowered. Therefore the developing agent does not collide with the inner wall 112 and falls into the developing chamber 210. Therefore, toner scattering, the decrease in the performance of the developing agent, the decrease in the image density may be decreased or prevented. Although the air introduced into the developing chamber 210 through the air introducing hole 113 by the rotation of the developing sleeve 13-1 is discharged through the first air discharge hole 140, the developing agent does not flow towards the first air discharge hole 140 due to the repulsive magnetic field formed by the magnet 270, the separating pole S2, and the receiving pole S3, and thus the leakage of the developing agent through the first air discharge hole 140 may be prevented. Since the magnet 270 is arranged on an upstream side of the first air discharge hole 140, the developing agent being leaked to the first air discharge hole 140 may be effectively prevented. In addition, since the developing agent is prevented from attaching to the magnet by the film 290 and the downstream side end 291 of the film 290 is extended over the downstream side end 271 of the magnet 270, the leakage of the developing agent through the first air discharge hole 140 may be effectively prevented. As described above, excessive rise of the air pressure inside the developing chamber 210, and toner leakage and excessive discharge of the developing agent due to the rise of air pressure may be reduced or prevented. since a travelling direction of the air introducing from the developing chamber 210 to the first air discharge hole 140 is changed to an opposite side of the gravity direction, the developing agent with heavy weight included in the air may falls into the developing chamber 210 and the leakage of the developing agent may be reduced or prevented.

Although the present disclosure has been described with reference to the examples shown in the drawings, it will be understood by those of ordinary skill in the art that various changes in form and details may be made therein without departing from the spirit and scope as defined by the following claims.

What is claimed is:

1. A developing device, comprising:

a developing chamber including an opening portion;

a developing sleeve located in the developing chamber and partially exposed to an outside of the developing chamber through the opening portion;

a magnetic member located inside the developing sleeve, the magnetic member including a separating pole and a receiving pole, the separating pole being located on a downstream side of the opening portion based on a rotating direction of the developing sleeve to separate a developing agent from the developing sleeve, and the receiving pole being located on a downstream side of the separating pole to attach the developing agent to the developing sleeve; and a magnet located between an inner wall of the developing chamber and the magnetic member, the magnet facing a region between the separating pole and the receiving pole, and the magnet having a same magnetic polarity as the separating pole and the receiving pole, wherein the inner wall includes a first air discharge hole to discharge air inside the developing chamber, and the magnet is located adjacent to the first air discharge hole.

2. The developing device of claim 1, wherein the first air discharge hole includes a filter to filter the developing agent.

3. The developing device of claim 1, wherein the magnet and each of the separating pole and the receiving pole are to provide a repulsive magnetic field to affect a trajectory of the developing agent separated from the developing sleeve.

4. The developing device of claim 1, wherein the magnet is located adjacent to an upstream-side end of the first air discharge hole based on the rotating direction of the developing sleeve.

5. The developing device of claim 1, comprising:

a developing agent attachment preventing member located between the magnet and the magnetic member to prevent the developing agent from attaching to the magnet.

6. The developing device of claim 5, wherein the developing agent attachment preventing member includes a film covering a surface of the magnet facing the magnetic member.

7. The developing device of claim 5, wherein a downstream-side end of the developing agent attachment preventing member extends over a downstream-side end of the magnet based on the rotating direction of the developing sleeve.

8. The developing device of claim 1, further comprising:

a second air discharge hole located on a downstream-side edge of the opening portion based on the rotating direction of the developing sleeve and located outside an effective image region in a longitudinal direction of the developing sleeve; and an air discharge path connecting the first air discharge hole to the second air discharge hole.

9. The developing device of claim 1, wherein the magnet faces a region between a position where a magnetic flux density of the separating pole in a normal direction is at a maximum and a position where a magnetic flux density of the receiving pole in the normal direction is at a maximum.

10. A developing device, comprising:

a developing chamber including an opening portion;

a developing sleeve located in the developing chamber and partially exposed to an outside of the developing chamber through the opening portion;

a magnetic member located inside the developing sleeve, the magnetic member including a separating pole and a receiving pole, the separating pole being located on a downstream side of the opening portion based on a rotating direction of the developing sleeve to separate a developing agent from the developing sleeve, and the receiving pole being located on a downstream side of the separating pole to attach the developing agent to the developing sleeve; and a magnet located between an inner wall of the developing chamber and the magnetic member, the magnet facing a region between the separating pole and the receiving pole, and the magnet having a same magnetic polarity as the separating pole and the receiving pole, wherein the magnet faces a region between a position where a magnetic flux density of the separating pole in a normal direction is at a maximum and a position where a magnetic flux density of the receiving pole in the normal direction is at a maximum.

11. The developing device of claim 10, wherein the magnet and each of the separating pole and the receiving pole are to provide a repulsive magnetic field to affect a trajectory of the developing agent separated from the developing sleeve.

12. A developing device, comprising:

a developing chamber including an opening portion;

a developing sleeve located in the developing chamber and partially exposed to an outside of the developing chamber through the opening portion;

a magnetic member located inside the developing sleeve, the magnetic member including a first magnetic pole and a second magnetic pole, the first magnetic pole and the second magnetic pole being located on a downstream side of the opening portion based on a rotating direction of the developing sleeve and having a same magnetic polarity, and a magnet located on an inner wall of the developing chamber, the magnet facing a region between the inner wall of the developing chamber and the first and second magnetic poles, and the magnet having the same magnetic polarity as the first magnetic pole and the second magnetic pole, wherein the inner wall includes an air discharge hole to discharge air inside the developing chamber, the air discharge hole includes a filter to filter a developing agent, and the magnet is located between the filter and the magnetic member.

13. The developing device of claim 12, wherein the magnet and each of the first magnetic pole and the second magnetic pole are to provide a repulsive magnetic field to affect a trajectory of the developing agent separated from the developing sleeve.

14. The developing device of claim 12, wherein:

the air discharge hole is a first air discharge hole, a second air discharge hole is located in a downstream-side edge of the opening portion based on the rotating direction of the developing sleeve and is located outside an effective image region in a longitudinal direction of the developing sleeve, an air discharge path connects the first air discharge hole to the second air discharge hole, and the magnet is located adjacent to the first air discharge hole.

15. The developing device of claim 14, wherein the magnet is located adjacent to an upstream-side end of the first air discharge hole based on the rotating direction of the developing sleeve.

16. The developing device of claim 15, comprising:

a developing agent attachment preventing member located between the magnet and the magnetic member to prevent the developing agent from attaching to the magnet.

17. The developing device of claim 16, wherein a downstream-side end of the developing agent attachment preventing member extends over a downstream-side end of the magnet based on the rotating direction of the developing sleeve.

18. The developing device of claim 12, wherein the magnet faces a region between a position where a magnetic flux density of the first magnetic pole in a normal direction is at a maximum and a position where a magnetic flux density of the second magnetic pole in the normal direction is at a maximum.

* * * * *